US006049946A

United States Patent [19]

Cress et al.

[11] Patent Number: 6,049,946

[45] Date of Patent: Apr. 18, 2000

[54] ADJUSTABLE HINGE

[75] Inventors: David R. Cress, Janesville, Wis.; Eric F. Friesen, Winnebago, Ill.

[73] Assignee: Newell Operating Company, Freeport, Ill.

[21] Appl. No.: 09/093,254

[22] Filed: Jun. 8, 1998

[51] Int. Cl.[7] ..... E05D 7/06

[52] U.S. Cl. ..... 16/240; 16/237

[58] Field of Search ..... 16/240, 242, 236–238, 16/249, 382, 272, 335

[56] References Cited

U.S. PATENT DOCUMENTS

| | | | |
|---|---|---|---|
| Re. 30,717 | 8/1981 | Dargene . | |
| 609,756 | 8/1898 | Curry . | |
| 4,159,557 | 7/1979 | Pittasch et al. . | |
| 4,185,357 | 1/1980 | Busse . | |
| 4,411,045 | 10/1983 | Röck et al. . | |
| 4,506,409 | 3/1985 | Lautenschläger . | |
| 4,517,706 | 5/1985 | Lautenschläger et al. . | |
| 4,590,641 | 5/1986 | Lautenschläger et al. . | |
| 4,604,769 | 8/1986 | Röck et al. . | |
| 4,615,072 | 10/1986 | Lautenschläger, Jr. . | |
| 4,641,393 | 2/1987 | Lautenschläger . | |
| 4,674,150 | 6/1987 | Salice . | |
| 4,716,622 | 1/1988 | DeBruyn . | |
| 5,052,077 | 10/1991 | Lautenschläger et al. . | |
| 5,271,670 | 12/1993 | Grabher . | |
| 5,283,929 | 2/1994 | Lin . | |
| 5,339,493 | 8/1994 | MacIntyre . | |
| 5,454,144 | 10/1995 | Rupprechter | 16/382 |
| 5,500,983 | 3/1996 | Lautenschläger . | |
| 5,603,142 | 2/1997 | Duback et al. . | |
| 5,604,956 | 2/1997 | Grass | 16/278 |
| 5,621,947 | 4/1997 | Fitz et al. . | |
| 5,664,288 | 9/1997 | Lautenschläger et al. . | |
| 5,826,305 | 10/1998 | Domenig et al. | 16/235 |

OTHER PUBLICATIONS

Form No. 272 (Profile SA System 2000 Hinge).

*Primary Examiner*—Chuck Y. Mah
*Attorney, Agent, or Firm*—Foley & Lardner

[57] ABSTRACT

An adjustable cabinet hinge for providing positional adjustment of a cabinet door relative to a cabinet frame is disclosed. The cabinet hinge includes a door wing to be mounted on a cabinet door, a frame wing to be mounted on a cabinet frame, a hinge arm that interconnects the frame wing and the door wing, and an adjustment screw, having a head and a shaft, that connects the frame wing to the hinge arm. The frame wing includes a slot and a first engagement area adjacent the slot. The slot has a width greater than the diameter of the head of the adjustment screw and the hinge arm includes a second engagement area to engage with the first engagement area on the frame wing. The hinge arm is rotatably connected to the door wing, and the hinge arm has a threaded aperture for engagement with the adjustment screw.

19 Claims, 3 Drawing Sheets

FIG. 3
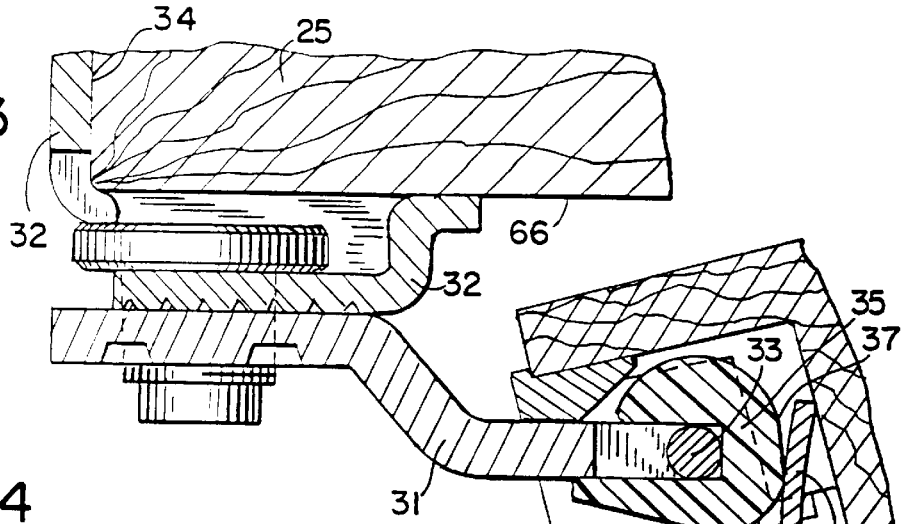
FIG. 4
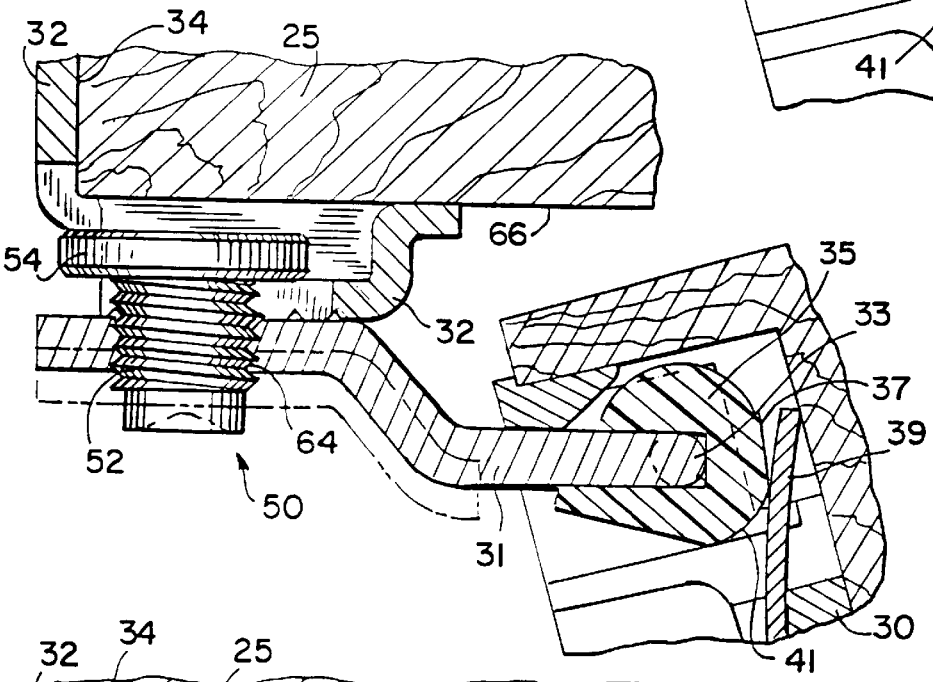
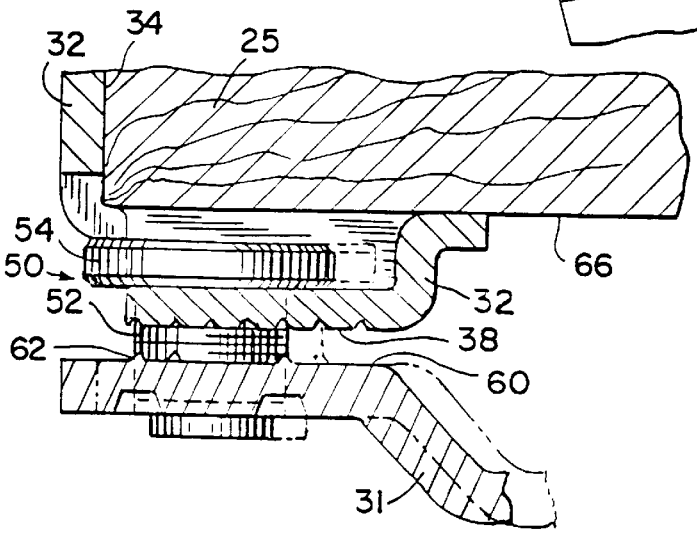
FIG. 5

ADJUSTABLE HINGE

FIELD OF THE INVENTION

The present invention relates to an adjustable hinge used to mount a door to a frame. Specifically, the present invention relates to a cabinet hinge with a frame wing that allows the cabinet hinge to be positioned for proper alignment without removing the hinge from the door or frame. More specifically, the present invention relates to a cabinet hinge with a frame wing, hinge arm, and adjustment screw that allows the door position to be adjusted without removal of the frame wing from the cabinet frame.

BACKGROUND OF INVENTION

Various arrangements are known for mounting a cabinet door to a cabinet frame. In a common arrangement a hinge is used to mount the door to the frame. The cabinet hinge includes a mounting structure (e.g. a door wing such as a mounting plate or hinge cup) which is fastened to the cabinet door by one or more fasteners (such as mounting screws) and a frame wing which is fastened to the cabinet frame and is movably connected with the mounting structure. The mounting of a cabinet door to a cabinet frame requires that the door be aligned with the cabinet frame for proper operation of the door as well as to provide a suitably aesthetic appearance. It is well known to use wood screws or like fasteners to mount the hinge to the cabinet frame and cabinet door. According to such known mounting arrangements a cabinet assembler may be required to drill holes for the wood screws. Precise mounting of the cabinet door to the cabinet frame requires precise positioning of the holes by the assembler. However, achieving sufficiently precise positioning of the holes is often difficult, due to measurement errors, machine tool inaccuracies, jig or tool wear or looseness, cabinet material variations, human errors, etc. As a result, adjustable cabinet hinges, which allow for adjustment of the position of the cabinet door with respect to the cabinet frame, have gained in popularity.

Accordingly, it would be advantageous to have an adjustable hinge that, among other things, is relatively simple in its design and relatively simple to manufacture and assemble, install and adjust. It would also be advantageous to have a hinge that requires as few as one fastener for mounting to the frame.

SUMMARY OF THE INVENTION

The present invention relates to a cabinet hinge including a door wing mounted on a cabinet door, a frame wing mounted on a cabinet frame and a hinge arm that interconnects the frame wing and the door wing. An adjustment screw connects the frame wing to the hinge arm in an adjustable relationship. The frame wing includes a slot and a first engagement area adjacent the slot. The hinge arm includes a second engagement area engagable with the first engagement area on the frame wing. The hinge arm is rotatably connected to the door wing.

The present invention further relates to an adjustable hinge mounting structure having a door wing mounted on a cabinet door for mounting the cabinet door to a cabinet frame and for providing a means to align the cabinet door to the cabinet frame. The mounting structure includes a frame wing mounted on the cabinet frame, a hinge arm that connects the frame wing and the door wing, and an adjustment screw that interconnects the frame wing to the hinge arm.

The hinge arm is rotatably connectable to the door wing and has a threaded aperture for engagement with the adjustment screw. The frame wing includes a slot, a first engagement area, and an aperture through which a mounting screw may be inserted to hold the frame wing to the cabinet frame. The hinge arm includes a second engagement area to engage with the first engagement area on the frame wing.

The present invention still further relates to a hinge adjustment mechanism, having a frame wing to be mounted on a cabinet face frame and having a first engagement region. The hinge adjustment mechanism also has an adjustment screw, having a slotted head and a threaded shaft having a diameter less than the slotted head, and the shaft having a slotted end opposite the slotted head. Further, the hinge adjustment mechanism has a hinge arm to interconnect the frame wing to a door wing including a threaded aperture for engagement with the threaded shaft of the adjustment screw and a second engagement region for engagement with the first engagement region of the frame wing.

BRIEF DESCRIPTION OF THE DRAWINGS

FIG. 3 is a cross sectional view taken along line 3—3 of FIG. 1, showing the hinge arm engaged with the frame wing.

FIG. 4 is a cross sectional view taken along line 4—4 of FIG. 1, showing the hinge arm engaged with the frame wing.

FIG. 5 is a cross sectional view similar to FIG. 3, showing the hinge arm partially disengaged from the frame wing.

DETAILED DESCRIPTION OF PREFERRED EMBODIMENTS

Referring to the FIGURES, preferred and alternative embodiments of an adjustable hinge, with an adjustable hinge arm, for mounting a cabinet door to a cabinet frame are shown. It should be noted at the outset that the hinge can be used in any of a wide variety of cabinet doors and other doors, including concealed and unconcealed hinge arrangements known to those skilled in the art who may review this disclosure.

Figure 1:
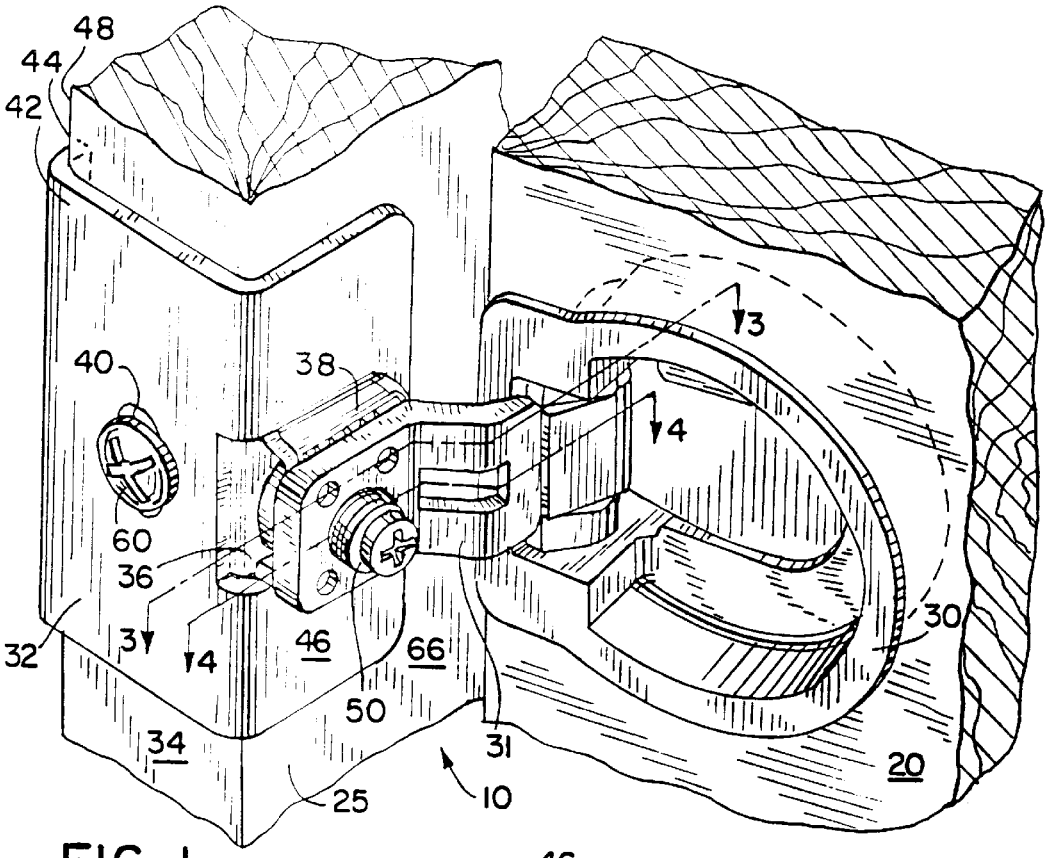
FIG. 1 is a perspective view of a cabinet hinge having a hinge cup, a frame wing, a hinge arm and an adjustment screw according to a preferred embodiment.

With reference to FIG. 1, a preferred embodiment of an adjustable hinge 10 is shown. Hinge 10 is used to mount a cabinet door or door stile 20 for selective pivotal movement between an opened position (shown in FIG. 1) and a closed position (not shown) with respect to a cabinet frame 25. In the embodiments shown in the FIGURES, cabinet door 20 is of an overlay type, as is described in U.S. Pat. No. 5,355,557 (entitled "CONCEALED SELF-CLOSING HINGE WITH INTEGRAL HINGE PIN MEANS") issued to Cress et al. on Oct. 18, 1994. Door 20 is shown in cutaway and may be made of any suitable material for a cabinet door including but not limited to wood, melamine, pressboard, metal, plastic, etc.

Referring to FIG. 1, hinge 10 includes a door wing 30 pivotally coupled to a frame wing 32. According to the preferred embodiment, door wing 30 (shown as, but not limited to, a hinge cup type door wing) is adapted to be mounted into and within a substantially cylindrical bore or recess (not shown) in door 20. Hinge cup 30 may be adapted to fit into other bore geometries, not limited to substantially cylindrical. Frame wing 32 is adapted to be mounted to an edge or jamb 34 (shown in FIGS. 1 and 3 through 6) of frame 25. According to a preferred embodiment, the hinge arrangement, having hinge cup 30 substantially embedded in door 20 and having frame wing 32 mounted to edge 34 of frame 25, is an arrangement designed to conceal the hinge from view, when viewed from the front of the cabinet. This arrangement is commonly known in the art as a "concealed" hinge. Hinge 10 also includes at least one mounting screw 60.

Hinge cup 30, as depicted in FIG. 1, is partially embedded in door 20 and fixed to door 20 by a frictional fit. Alternatively, hinge cup 30 may be fixed to door 20 by ridges or serrations on the outside edges of hinge cup 30, adhesives, screws or other fasteners, or any combination thereof.

Figure 6:
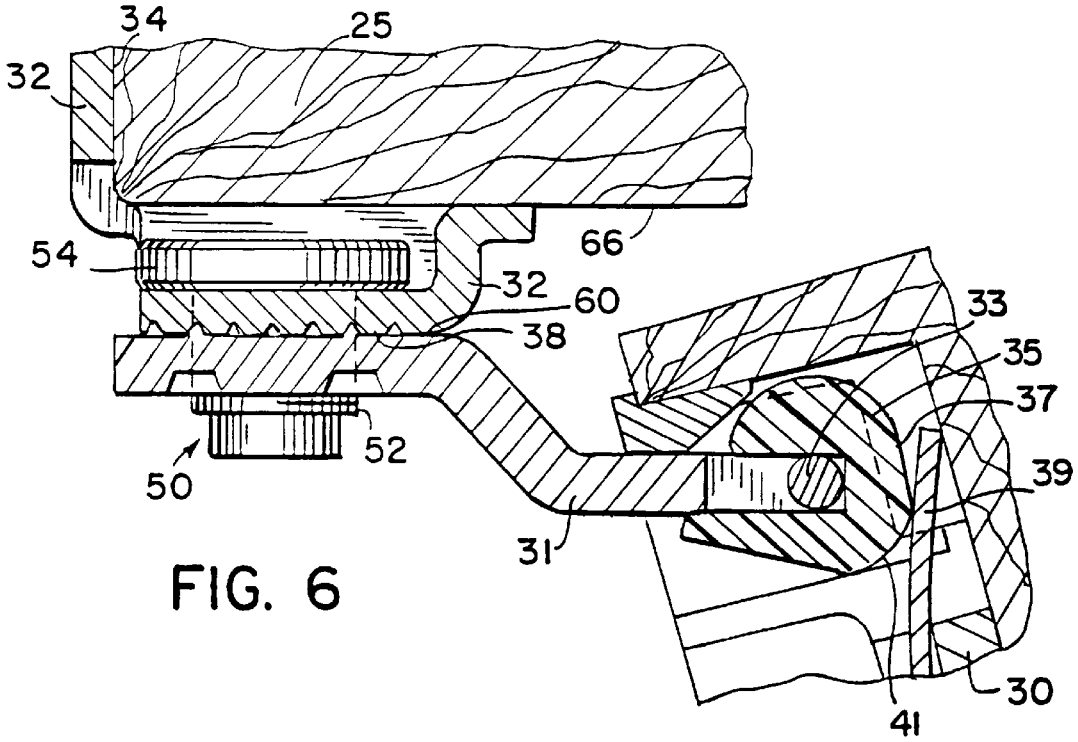
FIG. 6 is a cross sectional view similar to FIG. 3, showing the hinge arm engaged with the frame wing in an alternate position.

Referring temporarily to FIGS. 3, 4, and 6, hinge cup 30 is rotatably coupled to a hinge arm 31, typically by a pin 33 and a collar mechanism 35. Collar mechanism 35 is shown as a collar having a cam surface 37 for engagement with a leaf spring 39. Cam surface 37 provides a maximum open position for door 20 when leaf spring 39 and cam surface 37 come into substantially flush contact. Furthermore, the interface between leaf spring 39 and contour 41 causes door 20 to close when leaf spring 39 is substantially disengaged with cam surface 37. In a preferred embodiment collar mechanism 35 is the same type of collar mechanism disclosed in U.S. Pat. No. 5,027,474 (entitled "CONCEALED SELF-CLOSING HINGE WITH LEAF SPRING") issued to Bowers on Jul. 2, 1991. Alternatively, other collar configurations may be used in place of the cam type collar 35 depicted including, but not limited to, straight cylindrical collars.

Returning now to FIG. 1, in a preferred embodiment frame wing 32 includes a slot 36, a first engagement area 38, an oblong mounting slot 40, a base portion 42, a rear wrap portion 44 and a front wrap portion 46. In a preferred embodiment frame wing 32 is the same type of frame wing disclosed in U.S. Pat. No. 5,027,474 (entitled "CONCEALED SELF-CLOSING HINGE WITH LEAF SPRING") issued to Bowers on Jul. 2, 1991. Hinge frame wing 32 is preferably made from cold rolled low-carbon steel, but may be made from other suitable materials such as die cast zinc, other metals, ceramics, and polymers.

Frame wing 32 is illustrated fixed to frame 25 by a mounting screw 60. Mounting screw 60, which is preferably a wood screw although other suitable fasteners may be used, is inserted through oblong mounting slot 40 and screwed into edge 34 of frame 25. Because the length of oblong slot 40 is greater than the diameter of the shaft of mounting screw 60, the position of frame wing 32 with respect to cabinet frame 25 may be adjusted in the vertical direction by loosening mounting screw 60, sliding frame wing 32 in the desired vertical direction, and retightening mounting screw 60, so that frame wing 32 is firmly affixed to frame 25 and is substantially immovable under normal operational loads.

Still referring to FIG. 1, frame wing 32 has a rear wrap portion 44 that extends substantially perpendicularly from base portion 42 and is substantially flush with a rear surface 48 of frame 25 when frame wing 32 is properly configured and installed for normal use. Frame wing 32 also has a front wrap portion 46 extending substantially perpendicularly from base portion 42 of frame wing 32. Front wrap portion 46 is substantially flush with a front surface 66 of frame 25 when frame wing 32 is properly configured and installed for normal use. Frame wing 32 is known as a full wrap frame wing to those skilled in the art, because it has base portion 42, rear wrap portion 44, and front wrap portion 46. Alternatively, frame wing 32 may not include rear wrap portion 44 and instead include only base portion 42 and front wrap portion 46. Configured in this manner frame wing 32 is known as a partial wrap frame wing, to those skilled in the art.

Figure 2:
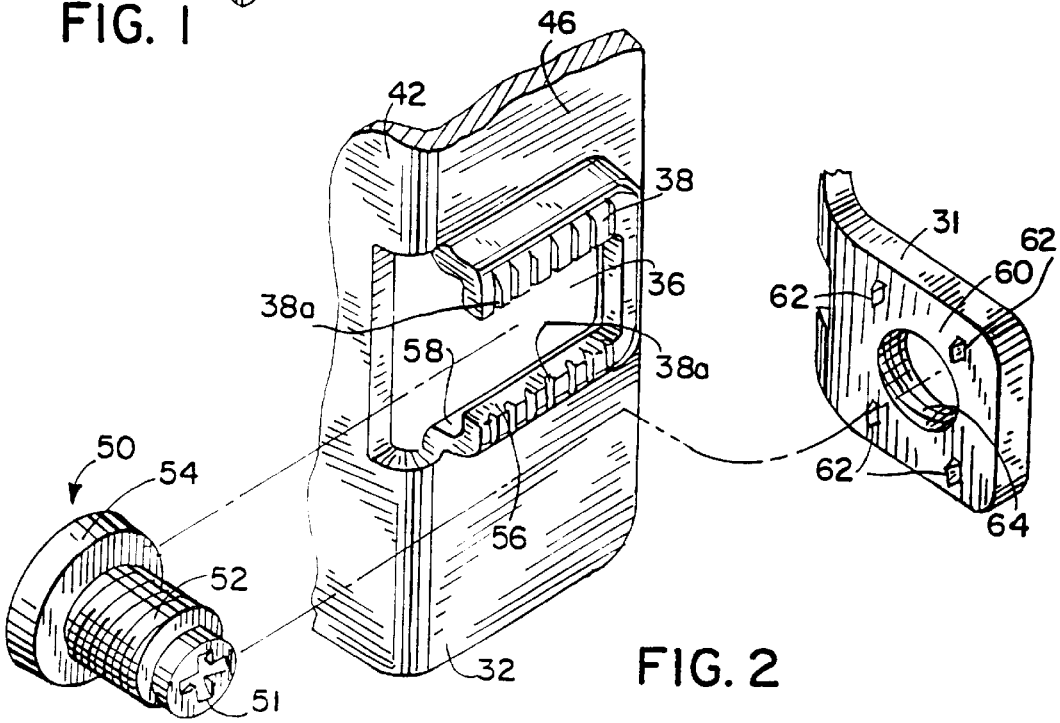
FIG. 2 is an exploded partial perspective view of the frame wing and hinge arm engagement area with the adjustment screw.

Referring now to FIG. 2, frame wing 32 is configured to act as a mounting structure for hinge arm 31. Frame wing 32 has a slot 36 to accommodate an adjustment screw 50. Slot 36 has an aperture 56 having a width greater than the diameter of a shaft 52 of adjustment screw 50 but less than the diameter of a head portion 54 of adjustment screw 50. Slot 36 also has a slide portion 58 having a width greater than the diameter of a head 54 of adjustment screw 50. Slot 36 is configured so that head 54 of adjustment screw 50 may slide into slide portion 58 of slot 36 but is held from being pulled through aperture 56 of slot 36 because the diameter of head 54 is larger than the width of aperture 56 of slot 36.

Frame wing 32 further has a first engagement area 38 adjacent to aperture 56 of slot 36. First engagement area 38 is configured to engage a hinge arm 31 by meshing with a second engagement area 60 of hinge arm 31. In a preferred embodiment first engagement area 38 includes a series of serrations 38*a* and second engagement area 60 includes a set of teeth 62 designed to mesh with serrations 38*a* of first engagement area 38. Alternatively, any suitable number of teeth 62 may be used, the design not being limited to the four shown. Also, it may be advantageous in some instances to have first engagement area 38 configured as a series of teeth and second engagement area 60 configured as several serrations, or any similar combination of meshing depressions and protrusions on first engagement area 38 and second engagement area 60.

Still referring to FIG. 2, hinge arm 31 includes a threaded aperture 64 configured to receive screw threads of adjustment screw 50 (alternatively a threaded nut, not shown, may be used in conjunction with an unthreaded aperture in hinge arm 31). With head 54 in slot 36, adjustment screw 50 may be screwed into threaded aperture 64. As adjustment screw 50 is screwed into aperture 64, second engagement area 60 is brought together with first engagement area 38 until both engagement surfaces are clamped together and teeth 62 mesh with serrations 38*a*. By loosening adjustment screw 50, hinge arm 31 may be moved in a horizontal direction such that door 20 may be adjusted in a horizontal direction with respect to the cabinet frame. When a desired position is attained, adjustment screw 50 may be tightened so that teeth 62 mesh with opposing serrations. Alternatively, slot 36, first engagement area 38, and second engagement area 60 may be configured such that the adjustment may be made in a vertical direction as opposed to a horizontal direction.

Referring now to FIGS. 3 through 6, hinge arm 31 is affixed in FIG. 3 in a leftmost position upon frame wing 32. FIG. 4 depicts hinge arm 31 affixed in the same position as in FIG. 3 but the cross section reveals threaded shaft 52 of adjustment screw 50 engaging threaded aperture 64 of hinge arm 31. To selectively reposition hinge arm 31 in a position to the right of the leftmost position shown in FIGS. 3 and 4, adjustment screw 50 is loosened as depicted in FIG. 5. Loosening adjustment screw 50 allows first engagement area 38 and second engagement area 60 to be disengaged, as depicted in FIG. 5. Hinge arm 31 may then be repositioned (for example, by sliding adjustment screw 50 and hinge arm 31 to the right) as depicted in phantom in FIG. 5. After adjustment screw 50 and hinge arm 31 have been moved to their new positions, adjustment screw 50 may be tightened to re-engage first engagement surface 38 with second engagement surface 60, as depicted in FIG. 6.

Figure 7:
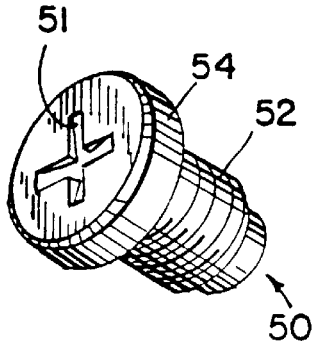
FIG. 7 is a perspective view of the adjustment screw showing the slotted head.

FIG. 7 shows adjustment screw 50 with tool engagement feature shown as a cross slot 51 (e.g. Phillips™ slot) recessed within head 54. FIG. 2 depicts adjustment screw 50 showing a similar cross slot 51 recessed within the end of shaft 52 opposite head 54. In a preferred embodiment it is desirable to have such a tool engagement feature at both ends of adjustment screw 50. (A recessed tool engagement feature is preferred because it retains the driving tool against slipping laterally out of engagement whereby the door is protected against being scratched.) Cross slots are preferred because the preferred tool is a conventional Phillips™ screwdriver. According to alternative embodiments, the engagement area may be a conventional screwdriver slot, internal hex, square, star, or other wrench recess, or any other configuration that facilitates application of a torque to the adjustment screw.

Figure 8:
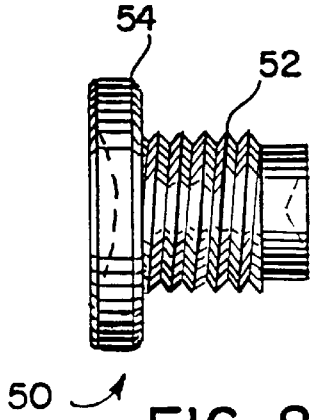
FIG. 8 is a side elevation view of the adjustment screw.

In a preferred embodiment threaded shaft 52 has a left hand thread, as shown in FIG. 8, such that, when viewed from head 54, a counter clockwise turn would tend to move adjustment screw 50 axially into a similarly threaded aperture. Therefore, when the adjustable hinge is assembled as depicted in FIG. 1, a counter clockwise torque applied to the end of shaft 52, opposite head 54, will cause first engagement surface 38 and second engagement surface 60 to become disengaged as depicted in FIG. 5. Likewise, when the adjustable hinge is in the position depicted in FIG. 5, a clockwise torque applied to the end of shaft 52, opposite head 54, will cause first engagement surface 38 and second engagement surface 60 to become engaged as depicted in FIG. 6. Thus, a left handed thread on shaft 52 is used to produce a conventional feel of use to a hinge adjuster. Alternatively, a traditional right handed thread may be used.

It is understood that, while the detailed drawings and specific examples given describe preferred exemplary embodiments of the present invention, they are for the purpose of illustration only. The apparatus and method of the invention are not limited to the specific details and conditions disclosed. For example, although a concealed cabinet hinge is depicted in the FIGURES, the present invention may be applied to other hinge types and styles. A non-concealed door wing may be installed to or within the outer surface of a door. Various changes may be made to the details disclosed without departing from the scope or spirit of the invention, which is defined by the following claims.

What is claimed is:

1. A cabinet hinge configured to pivotally and adjustably couple a cabinet door to a cabinet frame, comprising:

a door wing adapted to be mounted to the cabinet door;

a frame wing having a first engagement area, the frame wing adapted to be mounted to the cabinet frame;

a hinge arm having a second engagement area, the hinge arm adapted to pivotally and adjustably couple the door wing and the frame wing;

an adjustment screw adjustably coupling the hinge arm to the frame wing by selective engagement of the first engagement area and the second engagement area the shaft of adjustment screw having a diameter which is less than that of the head, the shaft having a first end adjacent the first end and a second end opposite the first end;

a first tool engagement area provided adjacent the head; and a second tool engagement area provided adjacent the second end of the shaft.

2. The cabinet hinge of claim 1 wherein the frame wing further comprises:

an oblong mounting slot; and a mounting screw that is inserted through the mounting slot, the mounting screw configured to couple the frame wing to the frame.

3. The cabinet hinge of claim 1 wherein the door wing includes a hinge cup configured to be substantially embedded in the cabinet door.

4. The cabinet hinge of claim 3 wherein the door wing includes a spring coupled to the hinge cup and the hinge arm includes a cam that engages the spring to aid in keeping the door in an open position and to aid in returning the door to a closed position.

5. The cabinet hinge of claim 1 wherein the frame wing is a full wrap frame wing.

6. The cabinet hinge of claim 1 wherein the first engagement area has a plurality of serrations and the second engagement area has at least one protrusion configured to mesh with at least one of the serrations.

7. The cabinet hinge of claim 1 wherein the second engagement area has a plurality of serrations and the first engagement area has at least one protrusion configured to mesh with at least one of the serrations.

8. The hinge of claim 1 wherein the shaft of the adjustment screw is provided a left hand thread.

9. The cabinet hinge of claim 1 wherein the frame wing includes a separate aperture for accepting a fixing screw.

10. The cabinet hinge of claim 9 wherein the separate aperture is oblong and configured to allow adjustment of the frame wing in a vertical direction of the cabinet.

11. An adjustable hinge mounting structure having a door wing configured to be mounted on a cabinet door for mounting the cabinet door to a cabinet frame and for providing a means to align the cabinet door on the cabinet frame, the mounting structure comprising:

a frame wing configured to be mounted on the cabinet frame, the frame wing including a track, and a first engagement area;

a hinge arm having a first end and a second end configured to couple the frame wing to the door wing, the hinge arm including a second engagement area adjacent the first end and configured to engage with the first engagement area on the frame wing, the hinge arm including a threaded aperture adjacent the first end, the first engagement area being positionally adjustable with respect to the second engagement area, the hinge arm configured to be pivotally coupled to the door wing adjacent the second end; and an adjustment screw, having a head and a shaft, configured to couple the frame wing to the hinge arm, the shaft engaging the threaded aperture and the track retaining the head.

12. The mounting structure of claim 11 wherein the frame wing further comprises:

an oblong mounting slot through which a fastener may be inserted to couple the frame wing to the frame.

13. The mounting structure of claim 12 wherein:

the shaft of the adjustment screw is provided a diameter which is less than that of the head;

the shaft is provided a first end and a second end opposite the first end, the head being located upon the first end; and a first tool engagement feature is provided within the head and a second tool engagement feature is provided within the second end of the shaft.

14. The mounting structure of claim 13, wherein the shaft of the adjustment screw has a left hand thread.

15. The mounting structure of claim 11 wherein the frame wing is a full wrap frame wing.

16. The mounting structure of claim 11 wherein the first engagement area has a plurality of protrusions and the second engagement area has at least one indentation configured to mesh with at least one of the protrusions.

17. The mounting structure of claim 11 wherein the second engagement area is configured to frictionally engage the first engagement area when the first engagement area is engaged with the second engagement area.

18. The mounting structure of claim 11 wherein the first and second engagement areas are configured to be positionally adjustable in a substantially horizontal direction with respect to each other, for making adjustments in the horizontal direction of the position of the door with respect to the frame.

19. A hinge adjustment mechanism, comprising:

frame wing to be mounted on a cabinet frame and including a first engagement region;

an adjustment screw, having a head provided with a first tool engagement feature and a threaded shaft having a diameter less than that of the head, the shaft also having a second end opposite the first end and provided with a second tool engagement feature;

a hinge arm configured to couple the frame wing to a door wing and including a threaded aperture for engagement with the threaded shaft of the adjustment screw and a second engagement region for engagement with the first engagement region of the frame wing and the first engagement area being positionally adjustable with respect to the second engagement area, wherein the head of the adjustment screw is configured to be retained adjacent the first engagement area.

* * * * *

UNITED STATES PATENT AND TRADEMARK OFFICE

CERTIFICATE OF CORRECTION

PATENT NO. : 6,049,946
DATED : April 18, 2000
INVENTOR(S) : Cress et al.

It is certified that error appears in the above-identified patent and that said Letters Patent is hereby corrected as shown below:

Title page,
Inventors: Linda G. Smith, Rockford, Ill.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*